219-121 SR

11/6/84 XR 4,481,636

United States Patent [19]

Curr et al.

[11] Patent Number: 4,481,636

[45] Date of Patent: Nov. 6, 1984

[54] ELECTRODE ASSEMBLIES FOR THERMAL PLASMA GENERATING DEVICES

[75] Inventors: Thomas R. Curr, Johannesburg; John F. Mooney, Roodepoort, both of South Africa

[73] Assignee: Council for Mineral Technology, Randburg, South Africa

[21] Appl. No.: 471,124

[22] Filed: Mar. 1, 1983

[30] Foreign Application Priority Data

May 5, 1982 [ZA] South Africa ..... 82/3076

[51] Int. Cl.[3] ..... H05H 1/26

[52] U.S. Cl. ..... 373/18; 219/121 PM; 219/121 PP; 373/22

[58] Field of Search ..... 373/18, 22, 23, 24, 373/25, 21; 219/121 PM, 121 PR, 121 PN, 121 PP, 121 P

[56] References Cited

U.S. PATENT DOCUMENTS 3,811,029 5/1974 Averyanov et al. ..... 219/121 PR X

*Primary Examiner*—Roy N. Envall, Jr.

*Attorney, Agent, or Firm*—Mason, Fenwick & Lawrence

[57] ABSTRACT

A thermal plasma generating electrode assembly of the type having a central, water-cooled electrode and an outer sheath defining therewith a path for gas is provided. The sheath is made as a non-water cooled sheath of a high melting, electrically conductive material to avoid damage to the electrode as a result of stray arcing by attracting such stray arcing to the sheath rather than the electrode. In addition the electrode can be retractable within the sheath to enable the latter to be employed for making initial electrical contact with the co-operating electrode of opposite polarity for the purposes of "striking" or initiating the arc upon start-up.

5 Claims, 1 Drawing Figure

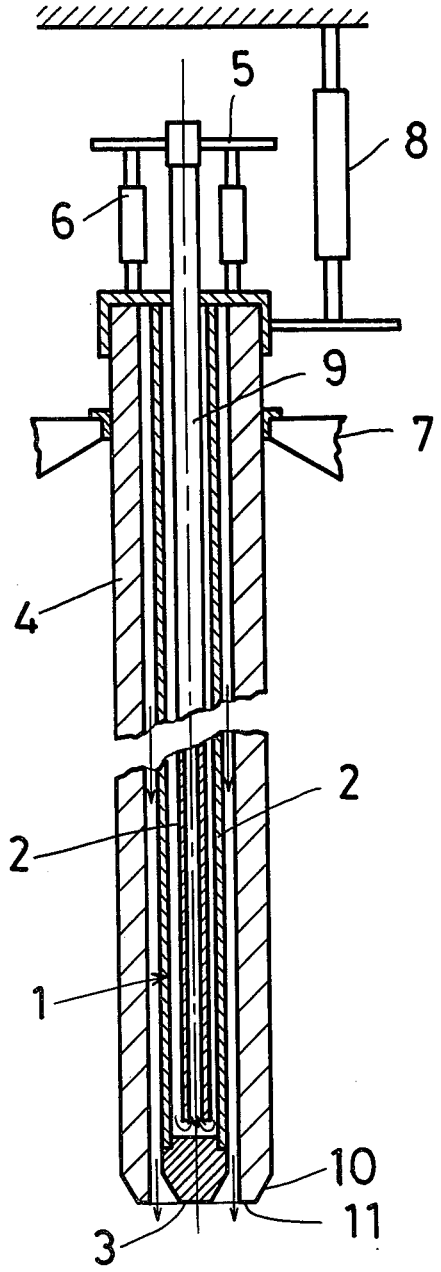
5
8
6
9
7
4
2
2
1
10
11
3

ELECTRODE ASSEMBLIES FOR THERMAL PLASMA GENERATING DEVICES

BACKGROUND TO THE INVENTION

THIS INVENTION relates to electrode assemblies for use in thermal plasma generating devices and, more particularly, to electrode assemblies of the type comprising a central water-cooled electrode surrounded by a sheath which, together with the electrode, defines an annular passage for the necessary gas to be ionised to form the plasma.

Generally such outer sheaths are also of a water cooled nature and are made of metal. These electrode assembles have associated therewith various problems, one of which is the problem of starting or striking the arc initially between the co-operating electrodes of opposite polarity. As a result of the fact that the one electrode is often a bath of molten slag or metal it is usually not possible for the other electrode to touch same in order to make initial electrical contact. These problems often result in damage to the electrode assemblies.

A further problem associated with such water cooled electrode assemblies is that, as a result of the fact that the sheath generally approaches the potential of the electrode, stray arcing onto the sheath can occur thereby damaging the sheath and ultimately the entire electrode assembly.

It is an object of this invention to provide an electrode assembly for use in thermal plasma generating devices which is easier to use for the purpose of initiating an arc preparatory to plasma generation and which, by its very nature, protects the electrode against stray arcing. The electrode assembly provided by this invention has, in addition, a variety of advantages which will be outlined below.

In this specification the term "high melting point" when applied to a material is intended to mean a material which has suitable high temperature properties, that is to say it does not melt or sublime below 2000° C. It will be noted that this term extends to materials which may sublime instead of melting.

SUMMARY OF THE INVENTION

In accordance with this invention there is provided an electrode assembly for a plasma generating device, the electrode assembly comprising a central water cooled electrode and a sheath held in spaced relationship relative thereto to define therewith a passage for gas along the outside of the electrode, the electrode assembly being characterised in that the sheath is of a non-water-cooled nature and is made of a high melting point, electrically conductive material.

Further features of the invention provide for the high melting point material to be graphite; for the sheath to be axially movable relative to the water cooled cathode; and for electrical connections between the sheath and electrode to be adapted for providing, if required, start-up by means of a high frequency spark generator but, preferably, means for enabling start-up to take place by extending the sheath forwardly over the cathode and into close proximity or contact with a co-operating electrode of opposite polarity as may be required.

Thus the sheath and electrode may be arranged to allow relative movement during operation so that the electrode tip can be withdrawn inside the sheath or projected therefrom as may be required. Preferably the electrical connections comprise a direct connection between the sheath and electrode or a connection via some resistance element. A direct connection would be typically used during normal operation so that the sheath and electrode would be at the same electrical potential relative to the co-operating electrode of opposite polarity.

In general provision will be made for measuring the current flowing in the electrode and sheath separately so that, during start-up, the path which is taken by the current can be monitored.

The electrode itself can conveniently be of a conventional construction having a metallic watercooled body terminating in a suitable operative tip, conveniently a tungsten tip, whereby the electrical energy is supplied to the plasma region.

The sheath can preferably be shaped to a truncated conical shape at its operative end so that, regardless of the actual diameter of the sheath selected, a small final tip area to the sheath relatively close to the electrode would result.

It will be understood that a start-up procedure could advantageously be as follows:

(i) the electrode would be retracted well within the sheath;

(ii) the entire electrode assembly could be lowered until direct contact or a high frequency spark initiates a relatively low current arc between the sheath and the co-operating electrode;

(iii) the device is raised a short distance to ensure that the operative tip of the sheath is well clear of the co-operating electrode surface;

(iv) the electrode is lowered relative to the sheath until electrical current measurements show that spontaneous transfer to the electrode has taken place from the sheath;

(v) a normal arc length and an increase in power to the desired level can then be achieved to commence normal operation of the plasma generating device.

It may be found that the incorporation of a resistance element in the current path from the sheath to the electrode, at least during the start-up procedure, enhances the arc transfer from the sheath to the electrode. However tests conducted to date have not shown this to be necessary provided a small tip area at the end of the sleeve is used.

BRIEF DESCRIPTION OF THE DRAWING

In order tht the invention may be more fully understood one embodiment thereof will now be described with reference to the accompanying drawing which is a schematic cross-sectional elevation of an electrode assembly installed in a furnace roof.

DETAILED DESCRIPTION WITH REFERENCE TO THE DRAWING

As illustrated, an electrode assembly comprises a conventional type of water-cooled cathode 1 composed of copper tubes 2 and having a tungsten operative tip 3. This type of cathode would typically be suitable for use in a d.c. transferred arc plasma device.

The cathode extends centrally and coaxially down a sheath 4 of annular cross-section and made of graphite material or any other suitable high melting point, electrically conductive material.

The sheath is mounted to a manifold 5 secured to the cathode by way of piston and cylinder assemblies 6 whereby the axial position of the cathode relative to the sheath can be varied. The cathode can thus be extended out of the sheath at its operative end or withdrawn into the operative end of the sheath as may be required. The entire assembly is adjustable in position relative to a furnace roof 7 by a primary electrode positioning mechanism 8.

The usual provision for introducing argon or other suitable gas to the annular passage 9 defined between the inner surface of the sheath and the external surface of the cathode will be provided as will be required electrical connections for the sheath and cathode as well as the water cooling of the latter.

As indicated by numeral 10 the operative end of the sheath can be formed to a truncated conical shape in order to provide a satisfactory small operative area 11 adjacent the cathode.

It will be understood that, in use, the cathode assembly can be employed as above described and no further description as to its operation will be necessary.

It will thus be clear that a cathode assembly according to this invention has a variety of advantages.

Firstly, the high current densities of water cooled electrodes are retained, resulting in small device dimensions since the uncooled sheath does not carry more than small starting currents and transient stray arcing currents.

The high temperature capability of the sheath and the lack of water cooling employed in this outermost surface of the electrode assembly affords the water cooled electrode with protection from stray arcing as indicated above. The use of the sheath as an arc initiator allows the device to be started in a closed furnace without the need for visual observation, as a result of the fact that it can be contacted directly with a molten slag or metal anode without damage being suffered to the water-cooled metallic cathode.

The use of a thermally resistant sheath between the furnace environment and the water cooled cathode as well as the nett decrease in water cooled surface area compared to a device employing a water cooled sheath results in a nett decrease in the heat losses and a consequent increase in the devices's thermal efficiency.

The small device size, since the sheath needs only to be sufficiently thick to maintain its mechanical integrity in a zero or relatively low current mode of operation, implies a low maintenance cost and short down time when compared to conventional graphite or Soderberg electrodes of similar power. The simple constructions of the water cooled components of this cathode assembly are associated with a lower inherent maintenance cost.

It will therefore be appreciated that an electrode assembly according to this invention provides an effective combination of advantageous characteristics of electrodes which have been made heretofore with an appreciable decrease of any disadvantages associated with any individual prior art type of electrode. The invention therefore provides a useful and effective electrode assembly for plasma arc generating devices.

We claim:

1. An electrode assembly for a plasma generating device, the electrode assembly comprising a central water cooled electrode and a sheath held in spaced relationship relative thereto to define therewith a passage for gas along the outside of the electrode, the electrode assembly being characterized in that the sheath is of a non-water-cooled nature and is made of an electrically conductive material having a melting point above 2,000° C.

2. An electrode assembly as claimed in claim 1 in which the high melting electrically conductive material is a graphitic material.

3. An electrode assembly as claimed in claim 2 in which the sheath is formed from solid graphite.

4. An electrode assembly as claimed in claim 1 in which the electrode is movable axially relative to the sheath between a retracted position and a normal operative position.

5. An electrode assembly as claimed in claim 1 in which the outer surface of the operative end of the sheath is formed to a truncated conical shape.

* * * * *